US012122018B2

(12) United States Patent
Lipkens et al.

(10) Patent No.: US 12,122,018 B2
(45) Date of Patent: Oct. 22, 2024

(54) SANDING ELEMENT AND METHOD FOR MANUFACTURING A SANDING ELEMENT

(71) Applicant: CIBO N.V., Tildonk (BE)

(72) Inventors: Heiko Lipkens, Tildonk (BE); Frederic Frenay, Tildonk (BE)

(73) Assignee: CIBO N.V., Tildonk (BE)

( * ) Notice: Subject to any disclaimer, the term of this patent is extended or adjusted under 35 U.S.C. 154(b) by 1191 days.

(21) Appl. No.: 16/640,439

(22) PCT Filed: Aug. 21, 2018

(86) PCT No.: PCT/IB2018/056319

§ 371 (c)(1),
(2) Date: Feb. 20, 2020

(87) PCT Pub. No.: WO2019/038674

PCT Pub. Date: Feb. 28, 2019

(65) Prior Publication Data

US 2020/0198095 A1 Jun. 25, 2020

(30) Foreign Application Priority Data

Aug. 22, 2017 (BE) ..... 2017/5578

(51) Int. Cl.
*B24D 3/00* (2006.01)
*B24D 11/00* (2006.01)
*B24D 18/00* (2006.01)

(52) U.S. Cl.
CPC ..... *B24D 3/002* (2013.01); *B24D 11/001* (2013.01); *B24D 18/0009* (2013.01)

(58) Field of Classification Search
CPC ..... B24B 37/20; B24B 37/22; B24D 18/0045; B24D 11/00; B24D 11/005; B24D 11/001; B24D 11/002; B24D 11/02; B24D 3/00; B24D 3/001; B24D 18/0009; B24D 3/002
See application file for complete search history.

(56) References Cited

U.S. PATENT DOCUMENTS 2,375,263 A * 5/1945 Upper ..... B24D 13/02 51/297
2,378,386 A 6/1945 Baumgartner
2,405,524 A * 8/1946 Sharpe ..... B24D 13/02 51/297

(Continued)

FOREIGN PATENT DOCUMENTS

WO 2006031475 A1 3/2006
WO 2016089672 A1 6/2016

*Primary Examiner* — Joel D Crandall
(74) *Attorney, Agent, or Firm* — BROWDY AND NEIMARK, PLLC

(57) ABSTRACT

Disc-shaped sanding element (1) and method for manufacturing this sanding element (1) with a circular circumference with at least two layers (4,5,6) bonded to each other containing abrasive grains (11, 12), wherein these layers (4,5,6) extend at least to the circumference of the sanding element (1) in order to form a sanding edge (8) on this circumference (7), wherein each of these layers (4,5,6) has layer properties including compressibility, abrasive grain density, abrasive grain size and grain material. The layers (4,5,6) contain a three-dimensional thread or fibre structure in which said abrasive grains (11,12) are distributed, wherein adjacent layers (4,5,6) have at least one different layer property.

18 Claims, 3 Drawing Sheets

(56) References Cited

U.S. PATENT DOCUMENTS 2,643,494 A * 6/1953 Erickson ..... B24D 5/02 51/297
2,981,615 A 4/1961 Baumgartner et al.
3,121,981 A * 2/1964 021964 ..... B24D 5/04 451/544
3,597,884 A * 8/1971 Kaarlela ..... B24D 5/12 451/544
3,802,130 A * 4/1974 Lindenbeck ..... B24D 5/14 451/544
3,867,795 A * 2/1975 Howard ..... C09K 3/1409 451/544
4,227,350 A * 10/1980 Fitzer ..... B24D 11/005 51/297
4,241,469 A * 12/1980 Perazzo ..... B24D 15/04 156/290
4,486,200 A * 12/1984 Heyer ..... B24D 3/002 451/532
4,546,515 A * 10/1985 Clayton ..... B32B 15/08 29/4.55
4,949,511 A * 8/1990 Endo ..... B24D 11/001 51/307
5,092,082 A * 3/1992 Padberg ..... B24D 5/02 51/297
5,346,516 A * 9/1994 Alkhas ..... B24D 3/28 51/296
5,366,800 A * 11/1994 Johnson ..... B24D 13/00 51/293
5,876,470 A * 3/1999 Abrahamson ..... B24D 5/12 51/307
5,928,394 A * 7/1999 Stoetzel ..... B24D 3/002 51/297
6,302,930 B1 * 10/2001 Lux ..... B24D 11/005 451/526
6,352,567 B1 3/2002 Windisch et al.
9,321,149 B2 4/2016 Van et al.
2012/0088443 A1 * 4/2012 Hsu ..... B24D 18/00 451/540
2013/0040537 A1 * 2/2013 Schwabel ..... C09K 3/1409 451/28
2013/0095735 A1 * 4/2013 Zhang ..... B24D 13/147 451/531
2015/0196992 A1 * 7/2015 Ficai ..... B24D 3/002 51/293
2016/0229032 A1 * 8/2016 Moren ..... B24D 3/00
2017/0144266 A1 * 5/2017 Sato ..... H01L 21/30625
2018/0043507 A1 * 2/2018 Sato ..... B24D 13/08
2018/0133867 A1 * 5/2018 Chandekar ..... B24D 3/001
2019/0030684 A1 * 1/2019 Van ..... B24D 5/14

* cited by examiner

SANDING ELEMENT AND METHOD FOR MANUFACTURING A SANDING ELEMENT

The invention relates to a disc-shaped sanding element having a circular circumference, which is to be driven around a central axis thereof. This sanding element comprises at least two layers adhered to each other containing abrasive grains, whereby these layers extend transversely to the central axis of the disc and parallel to each other. The layers hereby extend to the circumference of the sanding element in order to form a sanding edge at this circumference for machining a workpiece. Each of these layers has layer properties including compressibility, abrasive grain density, abrasive grain size and grain material.

More specifically, the invention concerns a sanding element which is usually mounted on a hand tool or a robot arm in order to subject the sanding element to a rotation around its central axis for finishing, in general, metal workpieces. When the sanding element is used, it is put against the surface of the workpiece to be sanded or polished with its circumference, which thus forms an abrasive edge, and it is moved over this surface. Such sanding elements are used for example for sanding or polishing welding seams on a workpiece, in particular a metal workpiece.

If the surface of a workpiece is to be smoothed or surface irregularities have to be removed, this is usually done, according to the state of the art, by successively employing different sanding elements. More specifically, the surface is successively processed by two or more sanding elements, whereby each subsequent sanding element contains smaller abrasive grains than the previous one. Thus, in a first step, imperfections of the workpiece are sanded away, whereby the surface is subsequently smoothed by and/or polished by a sanding disc with smaller abrasive grains.

Document US 2012/0088443 A1 discloses a sanding element consisting of successive layers of a non-woven material to which abrasive grains are bonded. Multiple layers are hereby placed on top of each other and compressed. The abrasive grains are distributed over the different layers.

Document U.S. Pat. No. 6,352,567 B2 discloses a flexible sanding disc consisting of non-woven fibres to which abrasive grains are bonded by means of a binder. The sanding disc contains two layers of binder with abrasive grains. A top layer is situated on the work surface of the sanding disc. The bottom layer is situated underneath it and will take part in the sanding process depending on the wear of the sanding disc.

A sanding disc made of composite material is described in document U.S. Pat. No. 9,321,149. This rigid sanding disc has two different layers with abrasive grains, whereby the first layer contains a larger amount of abrasive grains than the second layer. A reinforcement layer is provided on both sides of the sanding disc. Fibres provided in this sanding disc for reinforcement of the disc are completely embedded in resin and rigidly connected to each other, so that this sanding disc forms a completely rigid whole.

These known sanding elements are disadvantageous in that they do not enable to sand the surface of a workpiece and polish it in a single operation. In order to smooth the surface of a workpiece, it is necessary to first sand the surface with a sanding element containing coarse abrasive grains, whereafter in a final step, the surface is smoothed with a sanding element with fine abrasive grains. In other words, this means that each time another sanding element has to be mounted on a hand tool or a robot arm, which is laborious and results in a considerable loss of time.

The invention aims to remedy these disadvantages by proposing a sanding element which allows to remove material from the surface of a workpiece by sanding it, and to smooth and/or polish this surface in one single operation and with the same sanding element. Thus is achieved an important gain in time when smoothing the surface of a workpiece. In addition, fewer sanding elements should be kept in stock.

To this aim, said layers contain a three-dimensional thread or fibre structure in which said abrasive grains are distributed, whereby adjacent layers exhibit at least one different layer property.

Practically, the sanding element comprises a central layer with edge layers adjoining this central layer on both sides.

In an advantageous manner, abrasive grains with a smaller grain size than those of said central layer are distributed in said edge layers.

According to a special embodiment of the sanding element according to the invention, the compressibility of the central layer is smaller than that of said edge layers.

According to a preferred embodiment of the sanding element, said three-dimensional thread or fibre structure is formed of a non-woven structure of bonded synthetic fibres and/or plastic threads.

According to an interesting embodiment of the sanding element according to the invention, the sanding element is also at least partially elastically deformable.

The invention also concerns a method for manufacturing a sanding element, whereby successive thread or fibre blankets with an open three-dimensional structure are placed on top of each other, so that they extend practically parallel to each other. In these blankets, which contain for example a synthetic resin, abrasive grains are distributed. The whole of these successive blankets is compressed so as to bond the blankets together and produce an elastically bendable sheet in which these blankets form successive layers with a higher density than that of the blankets before they were compressed. Subsequently, said sanding element is cut out of the sheet in the shape of a circular disc.

This method is characterised in that at least a first blanket with abrasive grains is placed against a second blanket. The second blanket hereby has abrasive grains with a larger grain size than that of said first blanket.

According to an alternative method for manufacturing a sanding element according to the invention,

- in order to form a first layer, one or several thread or fibre blankets with an open three-dimensional structure, in which a synthetic resin with abrasive grains is distributed, are placed on the bottom plate of a press to form a stack of said blankets which extend practically parallel to each other, whereby
- this stack is subsequently compressed so as to bond the blankets together and to produce a sheet whose thickness is smaller than the thickness of said stack, wherein said blankets form a whole with a higher density than that of the blankets before they were compressed,
- whereby said sheet formed of blankets is made to cure at least partially.

This alternative method is characterised in that, subsequently,

- against at least one side of said sheet are placed one or several thread or fibre blankets with an open three-dimensional structure, in which a synthetic resin with abrasive grains is distributed, for forming at least a second layer, so as to form a second stack of blankets extending practically parallel to each other,
- said second stack is compressed against said sheet so as to form said at least one second layer adhered to this sheet, wherein said blankets, together with the sheet, form a whole with a higher density than that of said blankets before they were compressed, the whole is made to cure at least partially, at least one circular disc is cut from said whole which forms the sanding element.

The invention also relates to a method for processing a workpiece with a sanding element according to the invention, in which the sanding edge of the sanding element is put into contact with the surface of the workpiece and is moved over this surface while the sanding element is being driven around its axis and whereby a pressure is alternately exerted on this workpiece by different sanding zones of the sanding edge.

Other particularities and advantages of the sanding element and the method according to the invention will become clear from the following description of some special embodiments of the invention; this description is given as an example only and does not limit the scope of the claimed protection; the reference numbers used below refer to the accompanying figures.

Figure 6:
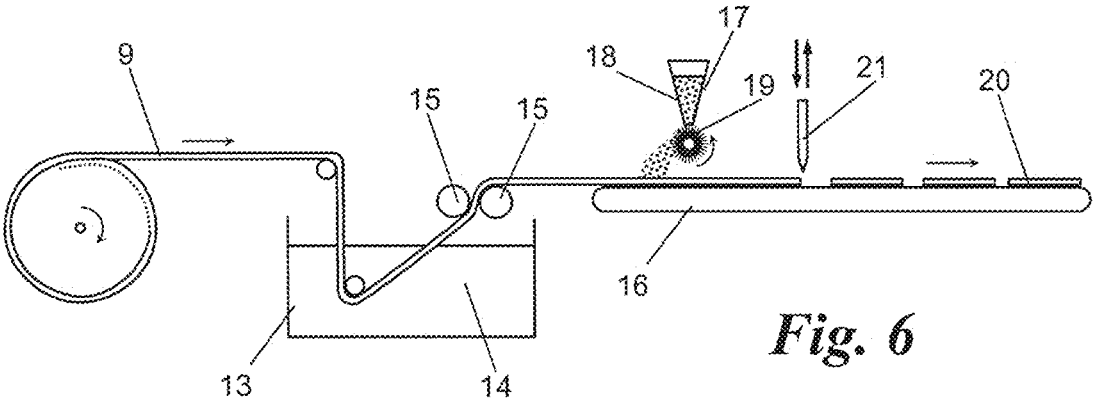

FIG. 6 schematically represents the production process for manufacturing thread or fibre blankets.

Figure 7:
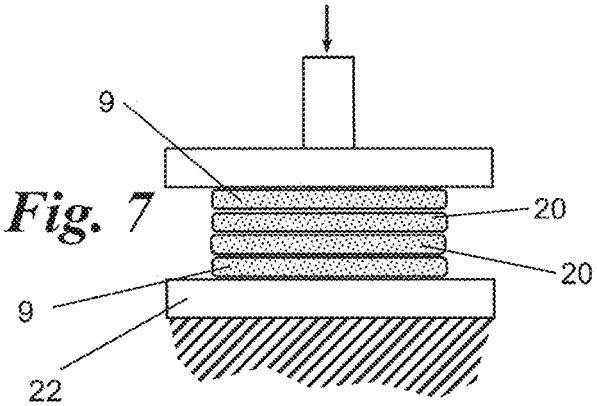

FIG. 7 is a schematic side view of a stack of blankets placed in a press.

Figure 8:
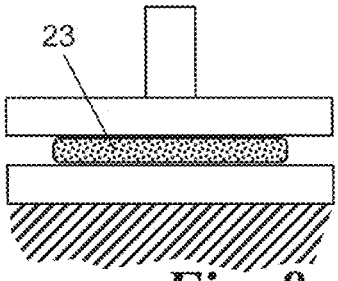

FIG. 8 is a schematic side view of the stack of blankets from FIG. 7 when they are compressed into a sheet in a press.

Figure 9:
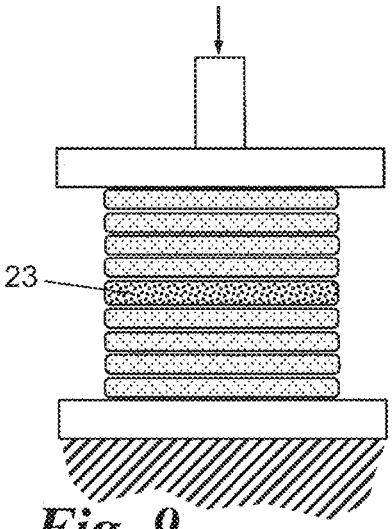

FIG. 9 is a schematic side view of the sheet from FIG. 8 when it is placed between two stacks of blankets in a press.

Figure 10:
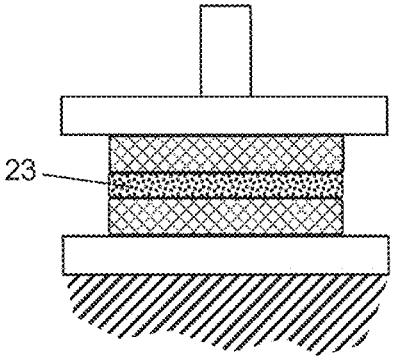

FIG. 10 is a schematic side view of the sheet and the stacks from FIG. 9, after they have been compressed in the press.

Figure 11:
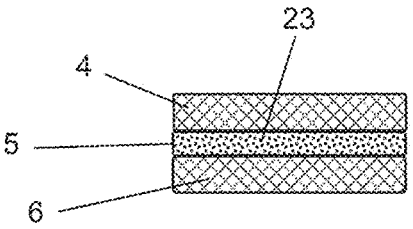

FIG. 11 is a schematic side view of the composite sheet from FIG. 10.

In the various figures, the same reference numbers refer to the same or analogous elements.

Figure 1:
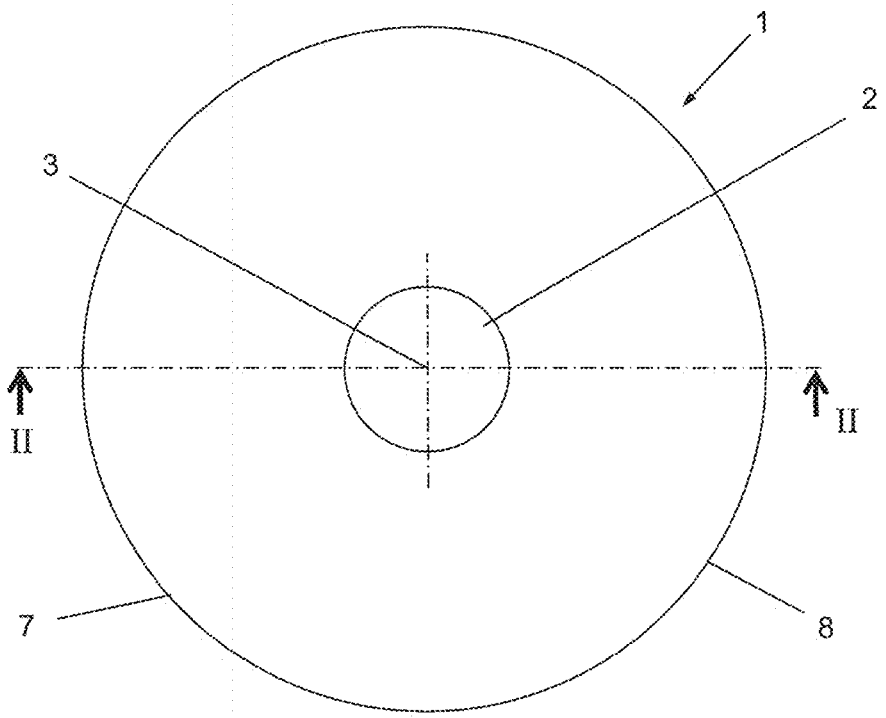
FIG. 1 is a schematic top view of a sanding element according to the invention.
Figure 2:
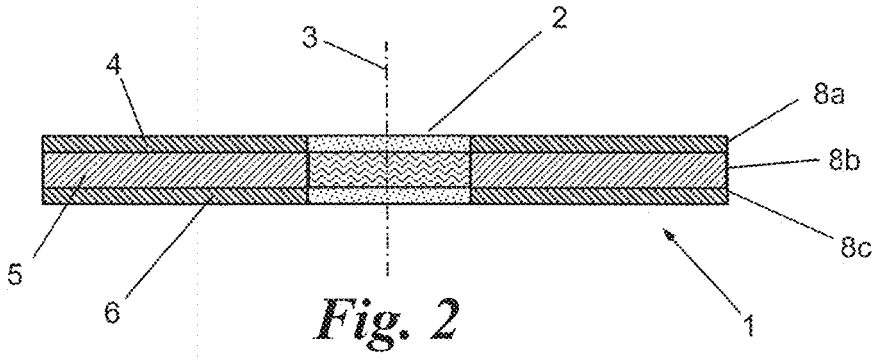
FIG. 2 is a schematic cross section of the sanding element according to a preferred embodiment of the invention, according to line II-II in FIG. 1.

The invention generally relates to a sanding element 1 having the shape of a circular flat disc, as schematically represented in FIGS. 1 and 2. This sanding element 1, also called sanding disc, can be mounted for instance on a hand tool which is preferably electrically driven, such as for example a so-called angle grinder or a straight grinder. Such a hand tool is known to persons skilled in the art. Naturally, the sanding element can also be mounted on a robot arm for use in an automated process.

In order to be mounted on a hand tool or another drive unit, the sanding element 1 has a central circular recess 2. Thus, the sanding element 1, after having been attached to a hand tool in a manner known as such, will be driven around its central axis 3. This central axis 3 extends more specifically perpendicular to the circular surface of the sanding element 1 and through the centre of the latter.

A sanding element 1 according to a first embodiment of the invention is represented in FIGS. 1 and 2. This sanding element 1 has three consecutively adjoining parallel layers 4, 5 and 6. These layers extend transversely to said central axis 3 and laterally to the circular circumference 7 of the sanding element 1. The lateral surfaces of these layers 4, 5 and 6 connect and extend according to the circumference of the sanding element 1. Thus, these lateral surfaces together form a sanding edge 8 of the sanding element 1. Consequently, this sanding edge 8 extends practically along a cylindrical surface at the circumference of the sanding element 1 and is subdivided in sanding zones 8*a*, 8*b* en 8*c* which correspond to the lateral surface of the respective layers 4, 5 and 6.

The layer 5 situated between the layers 4 and 6 thus forms a central layer, whereas the layers 4 and 6 connecting thereto on either side form so-called edge layers.

Each of said layers 4, 5 and 6 is formed of a so-called non-woven material of, preferably, synthetic fibres or plastic threads. More specifically, in the present description, by a non-woven material is understood a three-dimensional structure of preferably randomly arranged or non-ordered fibres or threads which are attached to each other by means of, for example, a thermosetting resin or which are partially fused together. The fibres or threads usually consist of polyamide or nylon. These fibres or threads may consist of other materials as well, such as for example glass fibre, polyester, polypropylene, cotton, viscose, acetate, wool, acrylic, Kevlar, aramid and/or ceramic fibre. Preferably, the non-woven structure contains mainly polyamide threads or polyester threads from 3 dtex to 500 dtex, preferably between 10 dtex and 100 dtex.

Figure 3:
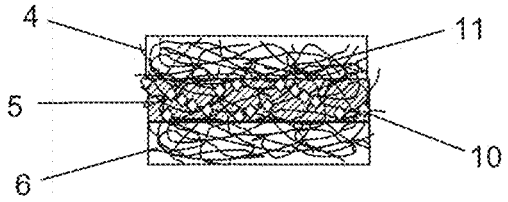
FIG. 3 is a schematic cross section to a larger scale of a part of a sanding element from FIG. 2 according to the invention, shown in more detail.

FIG. 3 schematically shows a part of a cross-section of the non-woven structure of the represented layers 4, 5 and 6 of the sanding element 1. Because of this structure, the different layers 4, 5 and 6 are somewhat compressible and flexible, and the sanding element 1 is as well.

The non-woven structure thus preferably consists mainly of fibres or threads, which are bound together by means of a synthetic resin and thus exhibit a three-dimensional open fibre structure, as shown in FIG. 3. As already mentioned, the fibres or threads may also be fused wherever they make contact.

The type of fibres or threads can be selected as a function of the desired compressibility, suppleness, wear-resistance, flexibility and/or durability of the sanding element 1. This is known to persons skilled in the art.

Preferably, said layers 4, 5 and/or 6 have a somewhat open structure. This ensures, for example, that any grinding dust being formed is easily disposed of and that the abrasive grains thus continue to act on the surface of a workpiece to be processed without their action being impeded by the formed grinding dust.

The open structure of the various layers also ensures that they are elastically deformable and compressible. Thanks to the open structure, preferably connected open volumes are present between the fibres or threads which allow the three-dimensional fibre or thread structure of the various layers of the sanding element to elastically deform, for example by bending or compression. Thus, the presence of the open structure ensures that the different layers of the sanding element as well as the sanding element itself can elastically deform, for example by bending and/or compression thereof. Indeed, the open volumes between the fibres or threads offer space within which the fibres or threads can deform.

Abrasive grains are distributed in the different layers 4, 5 and 6 of the sanding element 1. In said first embodiment of the sanding element 1 according to the invention, said central layer 5 contains abrasive grains with a grain size which is larger than that of the abrasive grains which are present in said edge layers 4 and 6. Preferably, both edge layers 4 and 6 contain the same type of abrasive grains, whereby the grit size of the abrasive grains from these two edge layers 4 and 6 is virtually the same.

Depending on the required application, however, different types of abrasive grains can be provided in the concerned layers 4, 5 and 6. Thus, properties of the abrasive grains such as, for example, hardness, sharpness and/or abrasion resistance are selected as a function of the material of a workpiece to be processed. Thus, for example, alumina abrasive grains, silicon carbide abrasive grains, zirconia abrasive grains and/or ceramic abrasive grains can be used. Also the density and/or the ratio of the different abrasive grains in the different layers may vary depending on the application. An agglomerate of these grains may also be used.

In the grinding element from FIG. 1 according to said first embodiment, the non-woven structure of the three layers 4, 5 and 6 is preferably identical or nearly identical and the layers only differ in the used type of abrasive grains and/or the number of abrasive grains per volume unit. As a result, the abrasion resistance of the different layers is practically similar as such.

The different layers can also be made with different types of abrasive grains in terms of size, hardness, grit, grain types and/or number of abrasive grains per volume unit depending on the desired applications.

In said first embodiment of the sanding element 1, said central layer 5 contains abrasive grains with a larger grit size than the abrasive grains which are present in both edge layers.

In order to fix the abrasive grains in the non-woven structure of the different layers 4, 5 and 6, they are bonded to the fibres or threads thereof with a resin. Different types of resin or synthetic resin can be used to that end, which are known to those skilled in the art.

In order to make sure that, when using the sanding element 1, the fibres or threads remain attached to each other and the abrasive grains remain bonded to the fibres or threads, irrespective of the heat generated during sanding, preferably a thermosetting synthetic resin is used as a resin.

In an advantageous manner, in this first embodiment of the sanding element, the thickness of both edge layers 4 and 6 is practically equal. The thickness of said central layer is for example double the thickness of each of both edge layers 4 and 6.

In one example, the thickness of each of the edge layers 4 and 6 is practically 1 mm to 2 mm, whereas the thickness of the central layer 5, for example, is of the order of 2.5 to 3.5 mm. Thus, the thickness of each of the layers 4 and 6, for example, is 1.5 mm and the thickness of the intermediate layer 5 is for example 3 mm, so that the total thickness of the grinding element 1 is then practically 6 mm.

The non-woven structure in which said abrasive grains are distributed is elastically deformable and, preferably, somewhat compressible. This ensures that the sanding element 1 is elastically deformable at least in a zone adjacent to said sanding edge 8. When the sanding element 1 is thus pressed with the sanding edge 8 against a workpiece to be processed and is moved over its surface according to a back and forth movement transverse to the direction of rotation of the sanding element 1, the zone adjacent to said sanding edge 8 will be slightly bent in an elastic way.

A hand tool which is not shown in the figures allows the sanding element 1 to rotate around its axis 3 at high speed while being pressed with the sanding edge 8 against a workpiece, such that the sanding zones 8*a*, 8*b* and 8*c* alternately or possibly simultaneously make contact with a surface to be finished of this workpiece.

The sanding element 1 according to the invention hereby makes an even contact with the surface of the workpiece with an essentially uniform pressure thanks to its compressibility and flexibility.

When moving the sanding element 1 with the sanding edge 8 according to a back and forth movement over the surface of a workpiece, this surface is alternately sanded by the sanding zone 8*a* or 8*c* and the sanding zone 8*b*. Thus, the surface is alternately processed with coarse abrasive grains from said second layer 5 and fine abrasive grains from the first layer 4 or third layer 6.

In this way, a rapid material removal by the abrasive grains from the second layer 5 can be combined with a fine finish by the abrasive grains from the first layer 4 or the third layer 6. The use of the sanding element 1 according to the invention makes it possible to finish the surface of a workpiece in a simple manner without the need to use different sanding discs or sanding elements.

The sanding element 1 can also be used to finish weld seams in a metal workpiece whereby the sanding edge 8 is moved over the weld seam and in the longitudinal direction of the latter, while the sanding element 1 rotates around its central axis 3. The sanding zone 8*b* of the central layer 5 hereby mainly makes contact with the weld seam, while the sanding zones 8*a* and 8*c* of the edge layers 4 and 6 mainly make contact with the surface of the workpiece adjacent to the weld seam.

In a second embodiment of the sanding element 1 according to the invention, it has three layers 4, 5 and 6 as well, as shown in FIG. 2. This sanding element 1 also has a central layer 5 and two edge layers 4 and 6, whereby the edge layers 4 and 6 show a greater compressibility than the central layer 5, however. This implies that the edge layers, under an identical pressure load as the central layer, will exhibit a greater compression or elastic deformation than is the case for the central layer.

The edge layers 4 and 6 may contain the same abrasive grains as the central layer 5, or possibly these edge layers may contain abrasive grains with a different grain size than those of the central layer. It is also possible to make the concentration of abrasive grains in the edge layers different from that of the abrasive grains in the central layer.

The sanding element 1 according to this second embodiment of the invention is for example particularly interesting for finishing weld seams. Especially for finishing a weld seam that is enclosed for example in an angle between two steel plates. In that case, the sanding element 1 is moved over the weld seam in the longitudinal direction of the latter, while the sanding element 1 rotates around its central axis 3. The weld seam thus extends in the plane of said central layer 5. The central layer 5 hereby makes contact with the weld seam via the corresponding sanding zone 8*b*, and material of the weld seam is thus removed. At the same time, the edge layers 4 and 6 of the sanding element 1 are pressed, with the sanding zones 8*a* and 8*c*, against the surface of the steel plates adjacent to the weld seam, whereby these edge layers 4 and 6 thus deform somewhat in order to exert an even pressure on the steel plate. As a result, the sanding element 1 in this way makes it possible to process and smooth a weld seam and the connecting surface in an angle enclosed between two plates which is normally difficult to access.

More specifically, the higher compressibility of the edge layers 4 and 6 with respect to the central layer 5 ensures that the sanding zone 8*b* of the latter can be pressed against the relevant weld seam.

Of course, the sanding element 1 according to this second embodiment can also be used in other configurations than those whereby a weld seam is present in an angle enclosed between two plates. Thus, the sanding element allows, for example, to smooth a weld seam between two steel plates extending along the same plane, as well as the adjacent zones. The smaller compressibility of the central layer with respect to the edge layers hereby ensures that material of the weld seam which is raised in relation to the surface of the plates is removed by the sanding zone 8*b* of the central layer 5, while the zones adjacent to the weld seam are polished smoothly by the sanding zones 8*a* and 8*c* of the edge layers which are thus pressed against the plates with a smaller pressure force.

According to a variant of this second embodiment of the sanding element according to the invention, it has several edge layers on each side of the central layer. The compressibility of these edge layers is greater here as they are further removed from the central layer.

Components

The manufacture of a sanding element according to the invention is based, among other things, on thread or fibre blankets with an open three-dimensional structure, one or several resins and one or several types of abrasive grains.

Said thread or fibre blankets with an open three-dimensional structure are usually formed of a so-called non-woven material. This non-woven material is manufactured from fibres or threads with the following properties:

- Thickness between 3 dtex and 500 dtex, preferentially between 10 dtex and 100 dtex
- Length between 5 mm and 250 mm, preferentially between 10 mm and 50 mm
- Consisting of nylon 6, nylon 66, polyester, rayon, cotton, viscose, acetate, wool, acrylic, Kevlar, aramid or ceramic fibre. The fibres or threads preferably consist of nylon or polyester.

In order to form said blankets, the fibres or threads are torn and spread out on a surface. The most commonly used methods use a so-called "random air laid machine" (type "Rando Webber") and "crosslapper". The blanket of non-woven material which is thus obtained is characterised by its fibre weight.

For the present invention, blankets with a fibre weight comprised between 15 g/m$^2$ and 1500 g/m$^2$ and preferably comprised between 50 g/m$^2$ and 300 g/m$^2$ are used.

The fibre or thread blankets that are used also contain a binder to bond the fibres together. Such a binder is applied to the blankets for example by means of spraying or another method. The binders used thereby are usually water-based emulsions or suspensions of acrylic, styrene-butadiene, polyvinyl acetate or phenol, but they can also be powdery, solvent-based, etc. After a binder has been applied, it is usually cured by making the blanket dry in an oven, for example.

Useful binders for the invention are for example acryl and styrene-butadiene distributed over the blanket with a weight of 5 g/m$^2$ to 250 g/m$^2$, preferentially 10 g/m$^2$ to 60 g/m$^2$.

Instead of using a binder to bond the fibres or threads together, fusion fibres may also be added, or the fibres or threads may be mechanically anchored to each other by needling.

When using fusion fibres, they are added to the fibres or threads and mixed with them. The formed mixture is then heated so that the fusion fibres melt at least partially. Subsequently, the whole is cooled, whereby the fusion fibres solidify again, thereby bonding the remaining fibres or threads together.

After the blanket has been provided with a binder, it has a weight of 20 g/m$^2$ to 1750 g/m$^2$, and preferably 60 g/m$^2$ to 360 g/m$^2$. The thickness of the blanket is between 1 mm and 30 mm, and preferably 5 mm to 10 mm.

Further, a resin is used to make abrasive grains adhere to the fibres or threads of the blanket. This resin ensures that the sanding element maintains its integrity during use. The resin may consist of a wide range of possible products, such as for example water-based emulsions of acrylic, styrene-butadiene, polyvinyl acetate, water-based solutions of phenol or polyvinyl alcohol, solvent-based products of phenol, polyurethane, epoxy, solvent-free polyurethane that is liquid at room temperature, etc.

In the present invention, for example, polyurethane with the following characteristics is used as a resin:

- Tg (glass transition temperature): at least 50° C., preferentially more than 80° C.
- Shore D hardness: at least 40
- Solvents: polar aprotic solvents such as MEK (butanone), MIBK (methyl isobutyl ketone) or PMA (propylene glycol methyl ether acetate).

Furthermore, additives can also be added to the resin, such as dyes, fillers, antifoam products, surfactants, antioxidants, abrasive additives, lubricants, solvents and co-solvents, "coupling agents", etc. The resin should preferentially contain less than 40% additives.

After the resin has been applied on the blanket, it is made to cure under conditions such as a temperature increase or cooling, or a reaction due to air humidity.

Further, in the sanding element according to the invention, almost all classical abrasive grains can be used, such as for example abrasive grains consisting of silicon carbide, zirconium, ceramic grain, alumina, diamond, emery, garnet (mineral), boron nitride, etc. Preferentially, however, the abrasive grains consist of silicon carbide or alumina.

To indicate the grit size or grain size of the abrasive grains, the FEPA standard (Federation of European Abrasive Producers) is used in the present description. The grain size may vary from F-4 tot F-2000, and preferably from F-36 to F-400.

A few methods for manufacturing a sanding element according to the invention are described below.

Method 1

Figure 4:
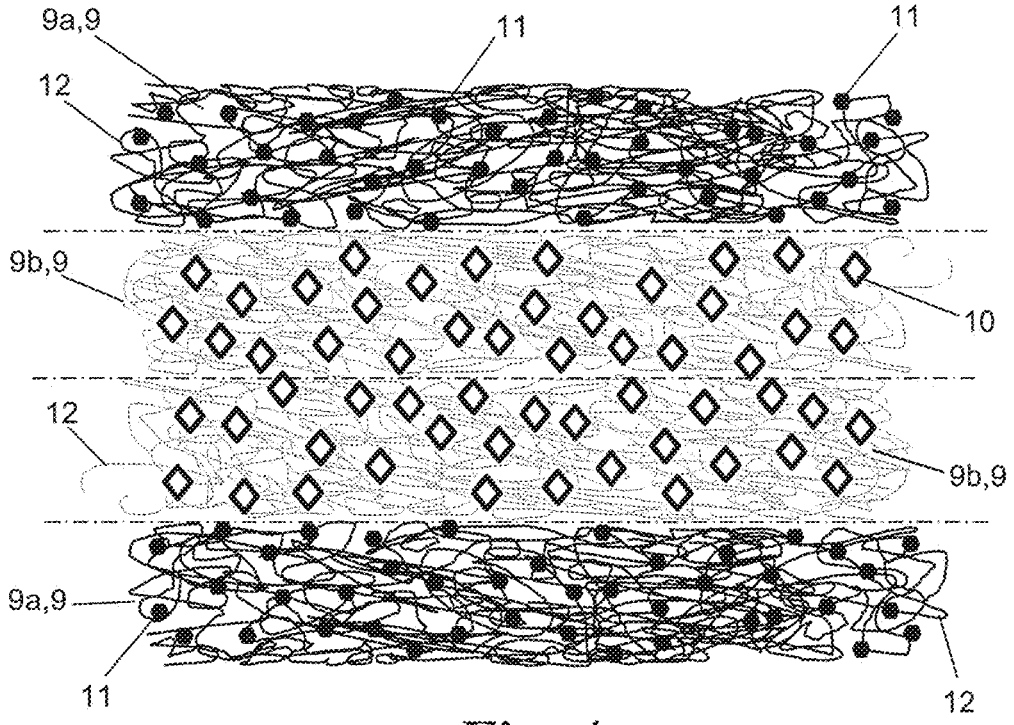
FIG. 4 is a schematic side view of thread or fibre blankets with an open three-dimensional structure placed on top of one another for manufacturing a sanding element according to the invention.
Figure 5:
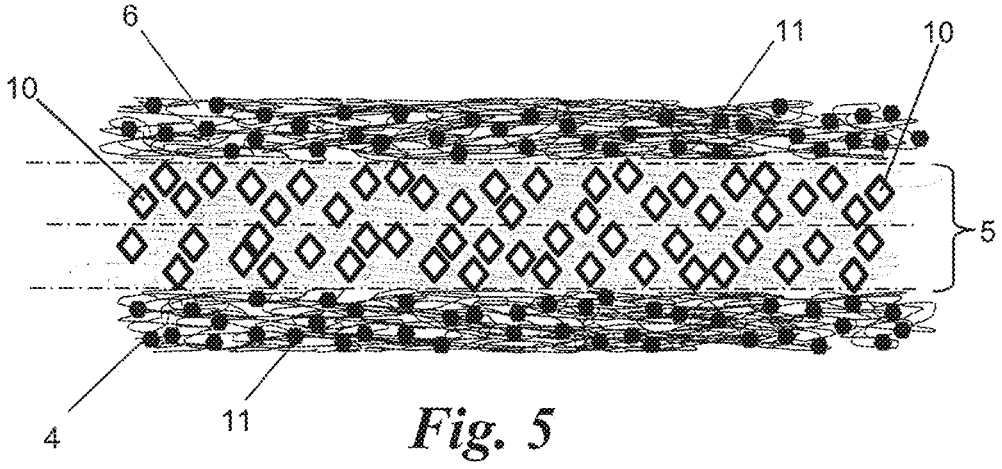
FIG. 5 is a schematic side view of the blankets from FIG. 4 after they have been compressed so as to form successive layers of the sanding element.

According to a first method, the sanding element 1 according to said first embodiment of the invention is manufactured, for example, by successively placing thread or fibre blankets with an open three-dimensional structure on one another and by compressing them at an elevated temperature, as is schematically illustrated in FIGS. 4 and 5.

Thus, thread or fibre blankets 9, as represented in FIG. 4, are placed on top of one another, whereby these blankets 9 extend parallel to each other. These blankets are formed of an open three-dimensional non-woven structure in which abrasive grains 10, 11 are distributed and are fixed in this structure. The fibres or threads 12 found in these blankets 9 are the same as those mentioned above with respect to layers 4, 5 and 6. These blankets 9 have an open structure and are relatively supple or flexible.

The abrasive grains 10 and 11 are distributed, for example, in a synthetic resin such as a thermosetting resin, which is applied between the fibres or threads of the blankets 9.

In the example shown in FIG. 4, four blankets 9 were placed on top of one another. Here, the top and bottom blankets 9*a* contain abrasive grains 11 having a smaller grain size than the abrasive grains 10 which are present in the two abutting blankets 9*b* extending between the blankets 9*a*.

Subsequently, the whole of the blankets 9 is positioned between two parallel plates of a press, whereby these blankets 9 are compressed in a direction transverse to their surface at a preferably elevated temperature. The different blankets are hereby bonded together as a result of the fusing of the fibres or threads from the different blankets 9 and/or as a result of the curing of said synthetic resin.

Thus, a layered sheet is formed as is schematically represented in FIG. 5. This sheet thus has a higher density than that of said blankets, but, preferably, it still has a somewhat open structure. By compressing the blankets 9, the number of abrasive grains per volume unit has increased. While compressing the sheet, it is made sure that it is still elastically bendable. In this connection, any person skilled in the art will be familiar with the pressure and temperature to be applied in order to obtain an elastically bendable sheet.

In this sheet, said blankets 9 form successive layers 4, 5 and 6 for said sanding element 1. Said blankets 9*b* which extend between said upper and lower blankets 9*a* thus form the central layer 5.

From this sheet is then cut or punched at least one circular disc forming the sanding element 1.

Method 2

A second method according to the invention allows, for example, to manufacture the sanding element 1 according to said second embodiment.

According to this second method, a thread or fibre blanket 9 with an open three-dimensional structure, in particular non-woven, is moved through a bath 13 with a liquid resin 14, as is schematically shown in FIG. 6. In this bath 13, the blanket 9 is impregnated with resin 14.

On leaving the bath 13, the blanket 9 is moved between two rollers 15 which exert a pre-set pressure on the blanket 9 so as to remove excess resin from the blanket 9 and make it flow back to the bath 13. Thus, the blanket 9 will have a predetermined resin weight when leaving the rollers 15.

Subsequently, the blanket 9 is guided under an abrasive grain distributor 17 by a conveyor belt 16, which contains a hopper 18 for abrasive grains and a rotating wheel 19. Abrasive grains flow from the hopper 18 to the wheel 19 and are spread, thanks to the rotation of the latter, onto the blanket 9 impregnated with resin and thus distributed on this blanket 9. As a result of the open structure of the blanket 9, the granules are distributed somewhat over the thickness of the blanket 9 as well.

The abrasive grain distributor 17 allows to dose the amount of abrasive grains falling on the blanket 9, such that a predetermined grain weight per unit area is applied on the blanket 9.

After the abrasive grains have been applied, the continuous blanket 9 is cut into pieces 20 of a certain length by means of an up and down knife 21.

A number of these pieces of the blanket 9 are placed on the bottom plate 22 of a preferably heated press, as is schematically shown in FIG. 7. A stack of said blankets 9 is thus placed in this press.

Subsequently, in the press, this stack is pressed together into a sheet whose thickness is smaller than that of the stack, as represented in FIG. 8. As a result of the pressing together of the blankets 9 at a raised temperature, they adhere to each other and form a whole with a higher density than that of the blankets 9. Thus is obtained a sheet 23 which is made to cure at least partially. To this end, sheet 23 is removed from the press and possibly made to cure in an oven.

In a following step, a second blanket 9 is moved through a bath 13 with possibly another liquid resin 14 in order to impregnate the blanket with resin, as represented in FIG. 6. Due to a certain pressure setting between both rollers 15, as already mentioned, a specific resin weight is applied to the blanket 9. Afterwards, abrasive grains are also applied to the blanket 9 with the aid of said abrasive grain distributor 17, and the blanket 9 is cut into pieces 20 by means of said knife 21.

A number of pieces 20 of this second blanket 9 are then placed on the bottom plate 22 of the preferably heated press. Said sheet 23 is then placed with its side on the formed stack of blankets 9, as shown in FIG. 9. Subsequently, on the opposite side of the sheet 23, a stack of pieces 20 of the blanket 9 is formed as well. Preferably, the same number of pieces 20 of blanket 9 are provided on either side of the sheet 23.

Finally, both stacks of blankets with said sheet 23 in between is compressed as a whole to a smaller thickness, which is normally larger than the thickness of the sheet 23. The adjacent blankets are hereby bound together and with said sheet 23, so that one whole is formed. This whole is removed from the press and then allowed to continue curing until it is fully cured, preferably in an oven. Thus, a combined sheet is formed as represented in FIG. 11.

From this combined sheet, the circular sanding element 1 according to the invention is cut, whereby said central layer 5 corresponds to said sheet 23, whereas the edge layers 4 and 6 are obtained from the compressed stacks which are adjacent to this sheet 23.

Method 3

According to a third method for manufacturing a sanding element according to the invention, in a first step, a fibre or thread blanket 9 with an open three-dimensional structure, in particular non-woven, is moved through a bath 13 containing a liquid resin 14 in which abrasive grains are distributed in suspension. This liquid resin may also contain volatile components, also called solvents.

On leaving the bath 13, the blanket 9 is moved between said rollers 15, as represented in FIG. 6, so as to allow excess resin to flow back to said bath 13.

The abrasive grain distributor 17, which is represented in FIG. 6, is normally not used in this method as the bath 13 also contains abrasive grains.

The impregnated blanket 9 is then dried in a drying oven so that any solvents present evaporate. After having been dried, the blanket 9 is still somewhat sticky and it is cut into pieces 20.

Subsequently, a number of pieces 20 of the blanket 9 are placed on top of each other so as to form a stack which is placed in a flat, square mould. This mould is compacted and clamped together, so that the stack is compressed to a smaller thickness. The mould with the stack is then placed in an oven where there is a first incomplete curing. Thus is obtained a pressed sheet 23 with a certain thickness which already has its final shape, but which has not fully cured yet.

In a second step of the method, the same type of blanket 9 as in the first step of the method is moved through a bath 13 containing another liquid resin 14. In this liquid resin 14, which also contains a solvent, abrasive grains are distributed in suspension. These abrasive grains are of another type than those used in the first step.

When the impregnated blanket 9 leaves the bath 13, it is moved between two rollers 15 so as to dose the amount of resin with abrasive grains in the blanket 9. Subsequently, the blanket 9 is made to dry in a drying oven in order to allow any existing solvents to evaporate. Once it has dried, the blanket 9 is cut into pieces 20.

A number of these pieces 20 are placed in a flat, square mould. The sheet 23 produced in the first step is placed on the mould, and the same number of pieces 20 of blanket 9 are placed on the latter as well.

The mould is closed at a thickness which is larger than the thickness of the sheet 23 obtained in the first step, but whereby said pieces 20 are compressed. The pieces 20 of the blanket 9 and the sheet 23 are thereby bound together and thus form a whole, as represented in FIG. 11. This whole is removed from the mould and made to cure further in an oven until it is fully cured.

The sanding element 1 is then cut from the cured whole.

The sanding element 1 according to the invention thus has consecutive layers 4, 5 and 6 which make sure that, at the periphery thereof, sanding zones 8*a*, 8*b* and 8*c* are created with different properties, whereby these sanding zones are adjacent as well. More specifically, the sanding element 1 has a sanding edge 8 over the entire circumference of the disc in which three sanding zones 8*a*, 8*b* and 8*c* extend according to this circumference. The sanding edge 8 forms the active part of the sanding element with which, preferably, contact is made with a workpiece. A first and a third sanding zone 8*a* and 8*c* extend on the outside of the sanding edge while a third sanding zone 8*b* located in between extends in the middle of the edge.

The properties of this sanding edge 8, composed of zones 8*a*, 8*b* and 8*c*, are therefore largely determined by the properties of the corresponding layers 4, 5 and 6 of the sanding element.

In the sanding element according to the invention, consecutive layers have at least one different layer property. One of these layer properties is, for example, the compressibility of the different layers. It was found, for example, that a sanding element whose central layer 5 has a smaller compressibility than the adjacent edge layers 4 and 6 is very interesting for finishing weld seams of a workpiece, as already mentioned above.

The compressibility of different interesting layers for a sanding element was tested according to ISO 11752 on a tensile tester. The machine used for that purpose was a Shimadzu type autograph AGS-X. The results were read with the accompanying software (trapezium X—version 1.4.0).

In order to determine the compressibility of a layer, the force required to achieve a certain compression of a sample of this layer is measured. To this end, a cylindrical sample of the layer with a diameter of 50 mm is used. This sample is placed between two parallel metal plates of the test machine. These plates on the test machine are cylindrical as well, with a diameter of 50 mm.

In the machine, the upper plate is then moved to the bottom plate until the plate makes contact with the sample at a force 1N. Then the test begins.

The upper plate is moved to the bottom plate, whereby the applied force increases by 10N per second and the sample is thus compressed.

When the sample is thus compressed over a distance of 2 mm, the force required to that end is recorded.

The table below provides an overview of the test results of samples taken from different types of layers.

| Sample number | Type | Web | Thickness (mm) | Number of blankets | Grain | Compression force (N) |
|---|---|---|---|---|---|---|
| T48 | Edge | B03 | 6 | 1 | AO 100 | 258 |
| T49 | Edge | B03 | 9.5 | 2 | AO 100 | 324 |
| T50 | Edge | COL | 6 | 2 | AO 100 | 397 |
| T51 | Edge | COL | 9.5 | 3 | AO 100 | 331 |
| T52 | Edge | COL | 9.5 | 4 | AO 100 | 499 |
| T53 | Edge | B03 | 6 | 1 | SC 150 | 200 |
| T54 | Edge | B03 | 9.5 | 2 | SC 150 | 292 |
| T55 | Edge | COL | 6 | 2 | SC 150 | 909 |
| T56 | Edge | COL | 9.5 | 3 | SC 150 | 273 |
| T57 | Edge | COL | 9.5 | 4 | SC 150 | 622 |
| S5 | Central or Edge | COL | 6 | 4 | SC 150 | 1066 |
| S6 | Central or Edge | COL | 6 | 5 | SC 150 | 3402 |
| S8 | Central | COL | 6 | 8 | AO 100 | 14166 |

In this table, the column "type" refers to "edge" when the sample comes from an edge layer and "central" when the sample comes from a central layer. The samples with numbers S5 and S6 can come from a layer which is used as an edge layer as well as from a layer which is used as a central layer.

The column "Web" indicates the type of non-woven material that makes up the layer. B03 refers to non-woven material with a weight of 185 g/m$^2$, whereas COL non-woven material has a weight of 105 g/m$^2$.

Further, the column "thickness" represents the thickness of the relevant layer of the sanding element, whereas the column "number of blankets" refers to the number of stacked blankets impregnated with resin and abrasive grains out of which the respective layer is formed.

The column "grain" indicates what type of abrasive grain is present in the measured layer. "AO 100" hereby stands for alumina grain with a grit size F-100, whereas "SC 150" refers to silicon carbide grain with a grit size F-150.

The column "Thickness" refers to the thickness of the sample. Since the total thickness of a sanding element comprising three layers corresponds to the thickness of both edge layers plus the thickness of the central layer, a sanding element with a thickness of 25 mm comprises for example a central layer with a thickness of 6 mm and two edge layers with a thickness of 9.5 mm each. The thickness shown in this table is therefore the thickness of a single layer of the sanding element.

The last column in this table shows the pressure force required to obtain a compression of the sample of 2 mm.

It is generally assumed that a sanding element for which the compression force in this last column is situated between 250 N and 1000 N for an edge layer sample, and between 1000 N and 4000 N for a central layer sample, gives very favourable results when it is used for processing the surface of a workpiece.

Thus, a sanding element according to said second embodiment may contain, for example, a central layer which is composed like sample S6, whereas on either side of this central layer is provided an edge layer having the composition of, for example, sample T56.

The table above shows only a few examples of layer samples for the sanding element according to the invention. Naturally, a sanding element according to the invention may be composed of a central layer selected from those indicated in the table above and one or several edge layers, referred to in this table, which are provided on either side of this central layer.

In general, the measured compression force for a compression of 2 mm, as set out above, is comprised between 250 N and 4000 N for a sample from an edge layer, and this compression for a sample from a central layer is situated between 750 N and 17500 N. Preferably, the sanding element is hereby composed such that this compression force for the edge layers is smaller than that of the central layer. The latter is in particular the case for a sanding element according to said second embodiment of the invention.

Although in the above-described embodiments of the invention, the sanding element 1 is formed of consecutive layers of a non-woven structure or of non-woven blankets 9, it is of course also possible to use other three-dimensional open fibre or thread structures to this end. Thus, for example, said layers 4, 5, 6 may be formed of a three-dimensional knit, a woven spacer fabric or a three-dimensional fabric with an open structure. This is also possible for said blankets.

The disc according to the invention is particularly interesting when it is used for removing a surface layer on metal surfaces or for smoothing weld seams in, for example, metal or steel surfaces.

The invention not only concerns sanding elements with three different layers 4, 5 and 6, but extends in general to layered sanding elements showing a succession of said layers, whereby the adjacent layers have at least one different layer property, such as for example a different abrasive grain size or a different compressibility.

Thus, for example, it is possible for a sanding element to have only two distinct layers or more than three layers, whereby every layer is provided with abrasive grains having a grain size which is different from the size of the abrasive grains in the other layers.

It goes without saying that applying abrasive grains on said blanket according to the described method can be done in many different ways. In addition to the above modes, given as an example, it can also be done by distributing a resin together with abrasive grains on the blanket, by means of spraying for example.

For the sake of completeness, it is further mentioned that a single layer of the sanding element preferably has a minimal thickness of 0.5 mm and is maximally 50 mm thick. This thickness is comprised, for example, between 1.5 mm and 10 mm. The total thickness of the sanding element is then between 1 mm and maximally 200 mm, and preferably between 3 mm and 50 mm.

The invention claimed is:

1. A disc-shaped sanding element with a circular circumference to be driven around a central axis thereof, the disc-shaped sanding element comprising at least two layers bonded to each other, each of the at least two layers containing abrasive grains, wherein the at least two layers extend transversely to said central axis and parallel to each other, while the at least two layers extend at least to the circumference of the sanding element in order to form a sanding edge on the circumference for processing a workpiece, wherein each of the at least two layers has layer properties including compressibility, abrasive grain density, abrasive grain size and grain material, wherein the at least two layers contain a three-dimensional thread or fibre structure in which said abrasive grains are distributed, wherein two adjoining layers of the at least two layers have at least one different layer property and wherein said three-dimensional thread or fibre structure has an open structure.

2. The sanding element according to claim 1, wherein said abrasive grains adhere to the threads or fibres of said three-dimensional thread or fibre structure.

3. The sanding element according to claim 1, wherein said three-dimensional thread or fibre structure is formed of fibres or threads connected to each other in discrete points or in discrete zones thereof.

4. The sanding element according to claim 1, wherein the at least two layers comprises a central layer with edge layers adjoining the central layer on either side.

5. The sanding element according to claim 4, wherein abrasive grains are distributed in said edge layers having a smaller grain size than those of said central layer.

6. The sanding element according to claim 4, wherein abrasive grains are distributed in said edge layers having a larger grain size than those of said central layer.

7. The sanding element according to claim 4, wherein said compressibility of the central layer is smaller than that of said edge layers.

8. The sanding element according to claim 4, wherein the thicknesses of said edge layers according to said central axis are almost equal.

9. The sanding element according to claim 4, wherein at least said edge layers are elastically compressible.

10. The sanding element according to claim 4, wherein the force required to achieve a compression of 2 mm according to ISO 11752 is larger for said central layer than for said edge layers.

11. The sanding element according to claim 1, wherein the sanding element has at least two adjoining layers, wherein the force required to achieve a compression of 2 mm according to ISO 11752 is larger for one of the at least two adjoining layers than for a second of said at least two adjoining layers.

12. The sanding element according to claim 1, wherein said three-dimensional thread or fibre structure is formed of a non-woven structure of bonded synthetic fibres and/or plastic threads.

13. The sanding element according to claim 1, wherein said three-dimensional thread or fibre structure is formed of a non-woven structure of polyester or nylon fibres and/or polyester or nylon threads.

14. The sanding element according to claim 1, wherein the sanding element is at least partially elastically deformable.

15. The sanding element according to claim 1, wherein the sanding element is layered such that the at least two layers comprise successive layers, wherein the abrasive grains of two adjoining layers of said at least two layers have a different grain size.

16. A method for manufacturing a disc-shaped sanding element with a circular circumference having at least two bonded layers containing abrasive grains, wherein the at least two bonded layers extend parallel to each other, while the at least two bonded layers extend at least to the circumference of the sanding element so as to form a sanding edge on the circumference for processing a workpiece, wherein the method comprises:

forming the first layer, the forming of the first layer comprising placing one or several thread or fibre blankets with an open three-dimensional structure in which is distributed a synthetic resin with abrasive grains on a bottom plate of a press to form a stack of said blankets extending practically parallel to each other, subsequently compressing the stack of said blankets so as to bond the blankets together and to produce a sheet whose thickness is smaller than the thickness of said stack, in which said blankets form a whole with a higher density than an average density of said blankets before they were compressed, curing said sheet, subsequently placing one or several additional thread or fibre blankets with an open three-dimensional structure against at least one side of said sheet, wherein the blankets comprise a synthetic resin with abrasive grains distributed therein, said additional blankets forming a second layer, wherein the additional blankets are stacked practically parallel to each other to form a second stack of blankets, compressing said second stack against said sheet to form said second layer which adheres to said sheet, in which said additional blankets, together with the sheet, form a whole having a higher density than an average density of said additional blankets before they were compressed, curing said whole, cutting a circular disc from said whole, wherein said circular disc forms the sanding element.

17. A Method for manufacturing a disc-shaped sanding element with a circular circumference having at least three bonded layers containing abrasive grains, wherein the at least three bonded layers extend parallel to each other, while the at least three bonded layers extend at least to the circumference of the sanding element so as to form a sanding edge on the circumference for processing a workpiece, wherein the method comprises:

forming the first layer, the forming of the first layer comprising placing one or several thread or fibre blankets with an open three-dimensional structure in which is distributed a synthetic resin with abrasive grains on a bottom plate of a press to form a stack of said blankets extending practically parallel to each other, subsequently compressing the stack of said blankets so as to bond the blankets together and to produce a sheet whose thickness is smaller than the thickness of said stack, in which said blankets form a whole with a higher density than an average density of said blankets before they were compressed, curing said sheet, placing one or several additional thread or fibre blankets with an open three-dimensional structure against both sides of said sheet, wherein the blankets comprise a synthetic resin with abrasive grains distributed therein, said additional blankets forming a layer on each side of the sheet, wherein the additional blankets are stacked practically parallel to each other to form a stack of blankets on both opposite sides of the sheet, compressing both stacks against said sheet to form a second and a third layer which adheres to said sheet on either side of the sheet, in which said additional blankets, together with the sheet, form a whole having a higher density than an average density of said additional blankets before they were compressed, curing said whole, cutting a circular disc from said whole which forms the sanding element.

18. The method according to claim 17, comprising placing an identical number of said additional thread or fibre blankets is on both sides of said sheet.

* * * * *